United States Patent [19]

Oetiker

[11] Patent Number: 4,724,729

[45] Date of Patent: Feb. 16, 1988

[54] PINCER-LIKE TOOL

[76] Inventor: Hans Oetiker, Oberdorfstrasse 21, CH-8810 Horgen 2, Switzerland

[21] Appl. No.: 777,340

[22] Filed: Sep. 18, 1985

[51] Int. Cl.[4] ..... B25B 27/00

[52] U.S. Cl. ..... 81/9.3; 81/415; 81/418; 72/410

[58] Field of Search ..... 81/9.3, 415, 418, 416, 427.5, 81/341, 394; 72/409, 410; 29/243.5, 243.51, 243.56, 268; 76/114, DIG. 6

[56] References Cited

U.S. PATENT DOCUMENTS

| | | | |
|---|---|---|---|
| 993,052 | 5/1911 | Giffen | 81/394 |
| 2,614,304 | 10/1952 | Oetiker | 24/20 R |
| 3,082,498 | 3/1963 | Oetiker | 24/20 R |
| 3,257,874 | 6/1966 | Madeira | 81/9.3 |
| 3,709,073 | 1/1973 | Kurtz | 76/114 |
| 4,492,004 | 1/1985 | Oetiker | 20/20 R |

FOREIGN PATENT DOCUMENTS

| | | | |
|---|---|---|---|
| 14604 | 5/1956 | Fed. Rep. of Germany | 76/114 |

*Primary Examiner*—Roscoe V. Parker

[57] ABSTRACT

A pincer-like tool for tightening clamps in which two pincer-like members are pivotally connected with each other, and connected with two actuating handle members, each pincer-like member includes engaging surface means near one end thereof for engagement with a corresponding surface of the clamp and a connecting portion near the other end thereof for connection with a respective actuating handle member so that movement of the handle members and therewith of the connecting portions toward each other will cause movement of the engaging surface means toward each other for purposes of tightening the clamp; the pincer-like members are thereby assembled from standard stamped-out steel parts which include nose-like end portions forming the engaging surface means.

15 Claims, 15 Drawing Figures

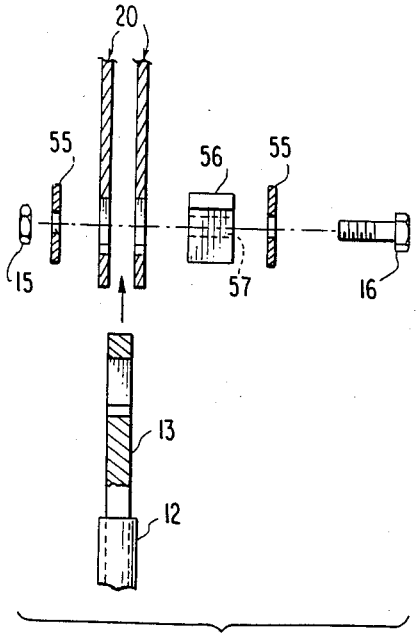
FIG. 4
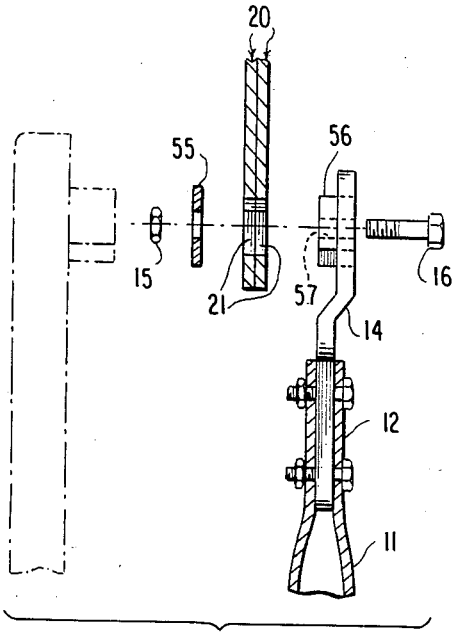
FIG. 5
FIG. 6
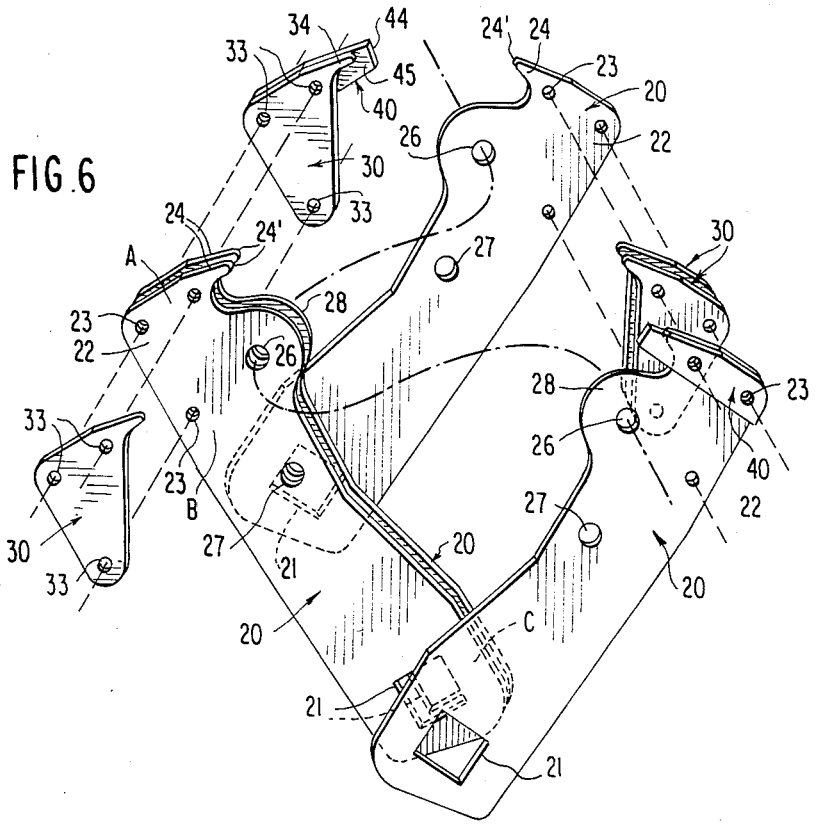

FIG. 13
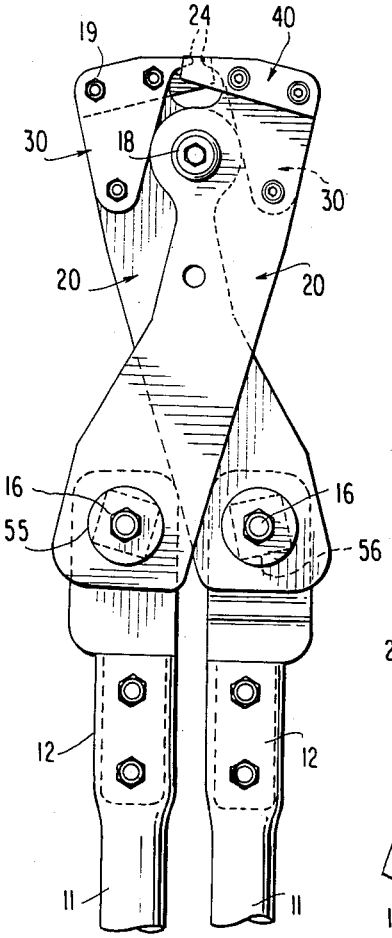
FIG. 14
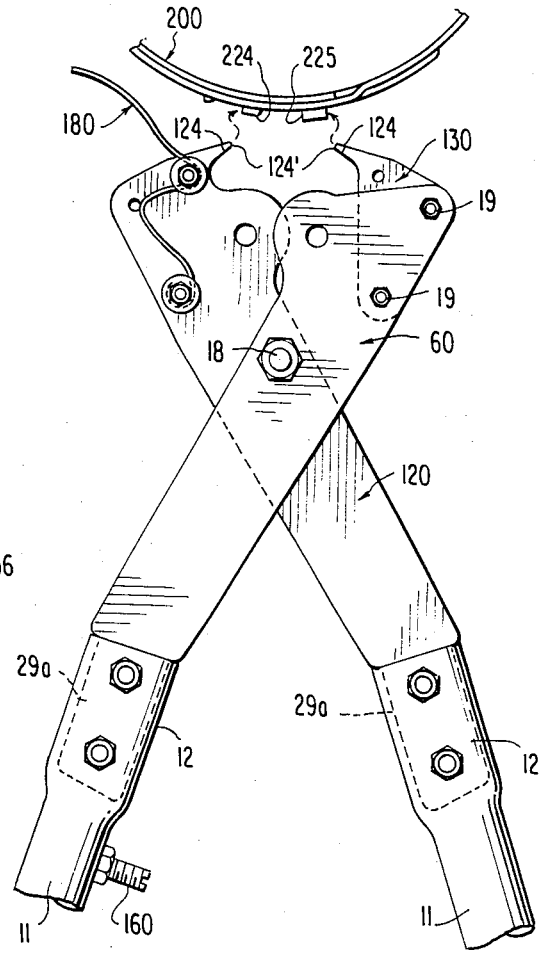
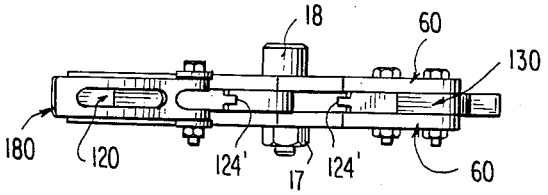
FIG. 15

PINCER-LIKE TOOL

The present invention relates to a pincer-like tool for tightening clamps.

Conventional pincers with two short handles and grasping jaws working on a pivot have been used heretofore for plastically deforming a so-called "Oetiker" ear in clamps of the type described, for example, in my U.S. Pat. Nos. 2,614,304 and 3,082,498. These type of pincers, made by forging, are relatively costly and likely to break under the application of very high forces necessary for reliably tightening certain clamps. Furthermore, these prior art pincers entail the disadvantage that the clamp might be destroyed during installation if the person incorrectly places the pincers over the ear so as to contact only a part of the ear with the jaws, thereby destroying the clamp.

Special tools were required heretofore to install earless clamps of the type disclosed, for example, in my prior U.S. Pat. No. 4,492,004. The pincer-like tools for tightening such clamps had to be specially made to provide small projecting tips at the jaws of the pincers capable of fitting into the circumferentially extending openings formed by outwardly extending embossments in the clamp. The manufacturing costs for such pincer-like tools were very high.

Moreover, it is frequently necessary to tighten the clamps with predetermined torque. Though so-called torquing keys are normally available in most repair shops, they could not be used with the prior art pincer-like tools.

Accordingly, it is the principal object of the present invention to provide a pincer-like tool which can be manufactured in a simple and relatively inexpensive manner and whose parts can be used to assemble different types of tools for tightening earless clamps as well as clamps provided with a so-called "Oetiker" ear.

The underlying problems are solved according to the present invention in that the pincer-like tool is assembled of a number of standard parts stamped out from steel plate material of such shape and configuration that they can be readily assembled. Additionally, by providing two holes in the standard stamped-out parts for the pivotal connection, it is possible to optimally adapt the assembled pincer-like tool to the requirements of a given application. For example, relatively high torques are required to close so-called "Oetiker" ears while less force but greater travel capability of the jaws is required for tightening an earless clamp. This can be achieved according to the present invention by merely changing the point of pivotal connection in the standard parts.

According to another feature of the present invention, the pincer-like tool in accordance with the present invention is equipped with guide means constituted by standard stamped-out cheek-like guide parts which are provided on opposite sides of the jaws of the pincer-like members and extend beyond the respective engaging surfaces so as to define a channel as the pincer-like tool is closed within which the ear must lie during closing.

According to still another feature of the present invention, if a pincer-like tool for tightening earless clamps is assembled from standard stamped-out parts, the arrangement is thereby such that sufficient guidance is provided to confine the jaws to purely pivotal movement notwithstanding the relatively large travel of the jaws of the pincer-like tool.

These and other objects, features and advantages of the present invention will become more apparent from the following description when taken in connection with the accompanying drawing which shows, for purposes of illustration only, several embodiments in accordance with the present invention, and wherein:

FIG. 4 is an exploded view illustrating the connection between the main standard stamped-out parts of one side of the pincer-like tool with its actuating handle member;

FIG. 5 is an exploded view, similar to FIG. 4, illustrating the connection of the main standard stamped-out parts of the other side of the pincer-like tool with its actuating handle member;

FIG. 6 is an exploded view, illustrating the assembly of the stamped-out standard parts into the pincer-like members forming the jaws of the tool of FIG. 1;

FIG. 13 is an elevational view of a pincer-like tool in accordance with the present invention made from standard stamped-out parts for closing an "Oetiker" ear, with the two pincer-like members forming the jaws shown in the closed condition;

FIG. 14 is an elevational view, illustrating a pincer-like tool assembled from standard stamped-out parts for tightening earless clamps; and FIG. 15 is a top plan view on the pincer-like tool of FIG. 14.

Figure 1:
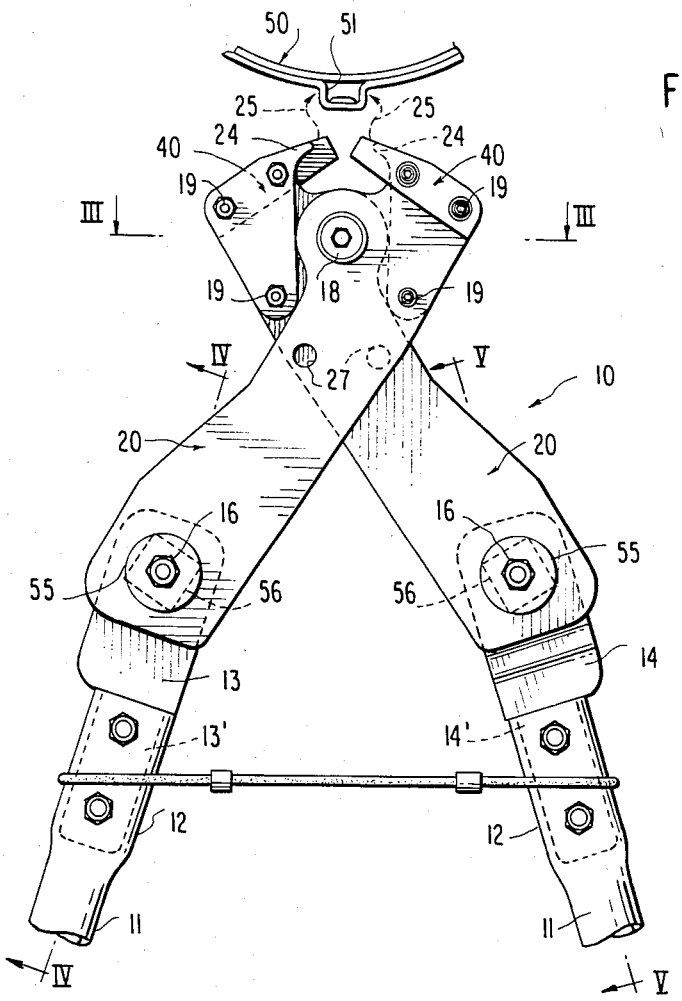
FIG. 1 is a partial elevational view of a pincer-like tool in accordance with the present invention for closing a so-called "Oetiker" ear in the course of tightening of clamps, with the parts thereof shown in the open position of the pincer-like tool.
Figure 2:
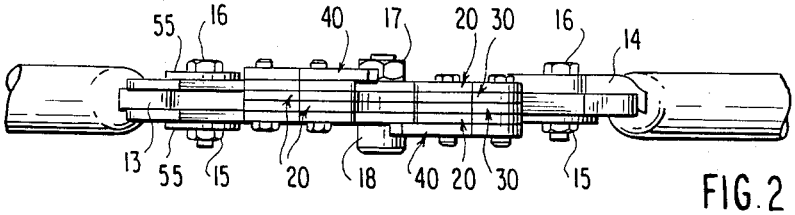
FIG. 2 is a top plan view on FIG. 1.
Figure 3:
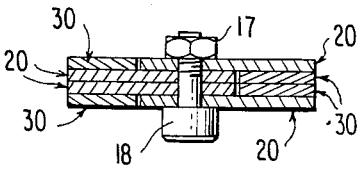
FIG. 3 is a cross-sectional view taken along line III—III of FIG. 1.

Referring now to the drawing wherein like reference numerals are used throughout the various views to designate like parts, the pincer-like tool generally designated by reference numeral 10 in FIG. 1 which is for tightening a clamp 50 provided with a so-called "Oetiker" ear 51 includes two tubular handle members 11 which are connected with the pincer-like members, properly speaking, and assembled of stamped-out standard parts by way of extension members 13 and 14, the former being straight, and the latter having an offset. The handle members 11 are thereby easily fastened to the shank portions 13' and 14' of the extension members 13 and 14 by any appropriate means, for example, by riveted connections, by threaded connections and/or being deformed into flattened portions 12 as shown. Preferably, the tubular members 11 are made of solid steel or the like to withstand the very high forces which come into existence with relatively long actuating handles and are then fastened by any conventional means, such as rivets, bolts and nuts or the like. The pincer-like members forming the jaws of the tool are pivotally connected with each other by way, for example, of a pivot bolt 18 and nut 17 (FIG. 2) or by any other disengageable pivotal connection, such as a pivot member held in place by a cotter pin or the like.

Each pincer-like member is assembled of a number of standard parts stamped-out from steel plate material having a thickness of about 2 to 4 mm. In the pincer-like tool of FIG. 1, as can be seen in particular from FIGS. 2 and 6, one pincer-like member (the left in FIG. 2) is composed of two main standard parts generally designated by reference numeral 20 which are followed along each side by a standard stamped-out spacer member generally designated by reference numeral 30, while the other pincer-like member (the right in FIG. 2) is composed of two standard stamped-out spacer members 30 followed on each side by a main standard stamped-out part 20. A guide channel to assure correct emplacement of the pincer-like members over a so-called "Oetiker" ear is formed by the use of two standard cheek-like guide members generally designated by reference numeral 40, of which one is assembled onto one side of the pincer-like member and the other to the opposite side of the other pincer-like member. The standard parts constituting each pincer-like member are thereby assembled and fastened together by any appropriate means, for example, by riveted connections 19 or by threaded connections extending through appropriate holes provided in each of the standard stamped-out parts.

Figure 9:
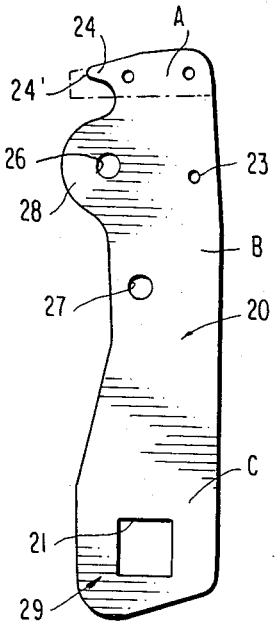
FIG. 9 is an elevational view illustrating the main standard stamped-out part used in pincer-like tools in accordance with the present invention.

Each main standard stamped-out part generally designated by reference numeral 20 thereby consists of a head section A followed by a center section B which is adjoined by a shank-like connecting section C. The configuration of the main standard part 20 can be best seen from FIGS. 6 and 9 which show the nose portions 24 of the head section whose end faces 24' form the ear-engaging surfaces of the jaws. The nose portions 24 are thereby formed by converging surfaces of which the outer converging surface goes over into a straight or slightly convex surface passing over by way of a rounded-off corner into the back surface of the main standard part. The lower converging surface passes over into the semi-circular projection 28 of the center section B by way of a generally semi-circularly shaped transition. Two holes 26 and 27 are provided in the center section B for selectively providing two pivotal connections. A square opening 21 in the shank portion 29 permits the installation of the square lug of a standard torquing key. For normal use, a square insert 56 provided with a round hole 57 is used to connect the extension member 13, respectively, 14 with the main standard stamped-out parts 20 with the use of a bolt 16 and nut 15 or riveted under interposition of washers 55 (FIGS. 4 and 5). This permits not only the selective use of a torquing key but also allows a quick interchange of actuating handles of different length as needed.

Figure 8:
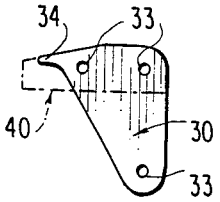
FIG. 8 is an elevational view of a standard stamped-out spacer member according to this invention also used in the pincer-like tools of the present invention.

The standard spacer member 30, best seen in FIGS. 6 and 8, generally conforms to the configuration of the head section A of the main standard part 20 and is provided with a similar nose-like end portion 34 as well as with similarly located fastening holes 33.

Figure 7:
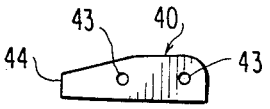
FIG. 7 is an elevational view, illustrating a standard stamped-out cheek-like guide member according to this invention, used with the pincer-like tool of FIG. 1.

The standard cheek-like guide member 40 (FIGS. 6 and 7) is provided with two fastening holes 43 spaced like the two top holes 23 and 33 of the main standard part 20 and of the standard spacer part 30. Its outer surface also generally conforms to the configuration of the outer surface of the main standard and spacer parts. However, the guide member 40 extends beyond the nose-like end portions 24 and 34 so that it provides a guide surface 45 in its extension 44, whereby the two guide surfaces of opposite guide members form therebetween a channel assuring correct application of the pincer-like tool on a so-called "Oetiker" ear as indicated by arrows 25 in FIG. 1.

Thus, the pincer-like tool of the present invention illustrated in FIG. 1 permits a torque-key-like tightening of the clamps with the precisely accurate jaw pressure and at the same time avoids possible damages to the clamp due to an improper application of the tool or to the rubber material of the part to be fixed.

Figure 11:
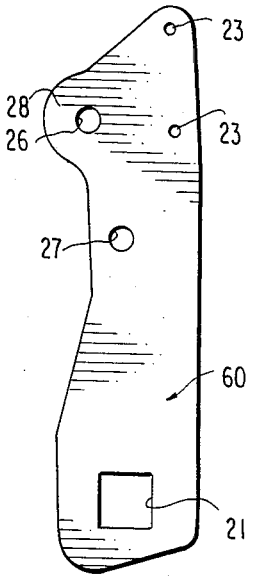
FIG. 11 is an elevational view of a modified main standard stamped-out part for use in assemblying a pincer-like tool in accordance with the present invention for tightening earless clamps.

For purposes of closing an earless clamp of the type described, for example, in my U.S. Pat. No. 4,492,004, the pincer-like tool is assembled again of standard stamped-out steel parts. More specifically, such a pincer-like tool, illustrated in FIG. 14, includes a main standard pincer-like member generally designated by reference numeral 120 (FIGS. 12 and 14) and two modified main standard stamped-out parts 60 (FIGS. 11 and 14) spaced by means of a standard spacer part generally designated by reference numeral 130. The main standard stamped-out part 120 is generally similar to the main standard stamped-out part 20 but illustrates a connection between the main stamped-out part 120 and the tubular actuating handle member 11 of solid material without the need of an extension member, by the use of an end portion 29*a* provided with fastening holes 29*a*' (FIG. 12) with which the actuating handle member is fastened by any conventional means. The modified main standard part generally designated by reference numeral 60 (FIG. 11) is similar to the main standard part 20 or 120 except that a portion of the head section A is cut off basically along a line tangential to the semi-circularly shaped projection 28 of the center section B. Additionally, to provide the nose-like end portions 124 with tips 124' of sufficiently small size to fit into the pressed-out embossments 224 and 225 of the earless clamp 200 (FIG. 14), the nose portions 24 of the main standard part 20 and the nose portion 34 of the standard spacer part 30 is ground-off or otherwise machined, as shown in FIG. 15, so as to leave a shoulder on each side of the tip 124'.

To provide a longer travel distance for the nose-like end portions 124, the pincer-like tool of FIGS. 14 and 15 utilizes the second holes 27 thereby reducing the lever arm for the force application but increasing the travel length. Additionally, the two modified main standard parts 60 provide a completely satisfactory guidance for the main standard part 120 during its pivotal movement to assure that the standard part 120 is limited to a pivotal movement without side movement which might hinder the tightening of the earless clamp. Furthermore, to prevent damage to the tips 124' of the nose-like end portions 124, when closing the pincer-like members in the absence of a clamp, one of the handle members 11 is provided with a preferably adjustable stop limiting the closing of the tool.

To achieve different lengths for the actuating handle members, tubular members (not shown) may be fitted over the actuating handle members 11 of solid material which are held in place by conventional spring-loaded detent mechanisms provided in the solid handle members and which are able to engage in corresponding openings in the tubular members so as to fix their length position in different locations where these openings are provided.

Moreover, the pincer-like tool for closing an earless clamp may be provided with a properly contoured spring member 180 suitably fastened to the main standard member 120. The spring 180 places the outer free end of the clamp down over the inner band portion during installation of the clamp, whereby the clamp automatically assumes its closed condition without having to bring down the end by hand. During the disassembly, the pincer-like tool is merely rotated through 180° in order that the outer band end can be easily lifted out of the guide hook during the opening of the clamp. This permits removal of the clamp without destroying its reusability.

Figure 10:
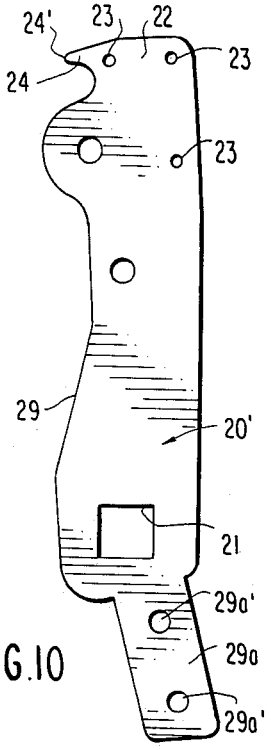
FIG. 10 is an elevational view, similar to FIG. 9, illustrating a modified embodiment of a main standard stamped-out part for use with the present invention.
Figure 12:
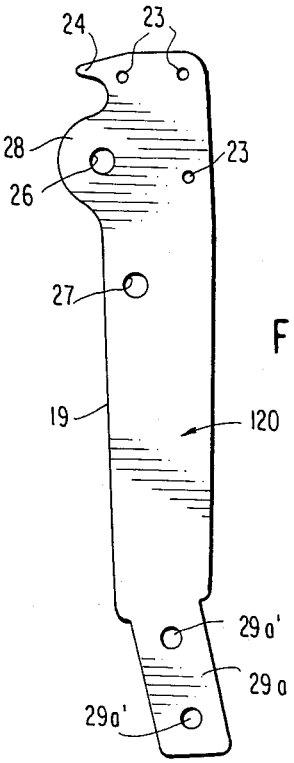
FIG. 12 is an elevational view of a modified embodiment of a main standard stamped-out part for use in the pincer-like tool according to the present invention.

FIG. 10 illustrates a main standard part 20' similar to main standard part 20 but modified to include an end portion 29a provided with fastening holes 29a', as described in connection with FIG. 12, to eliminate the connecting portions 13 and 14 of the embodiment of FIGS. 1–9.

The pincer-like tool of the present invention offers numerous advantages. First, it permits a rational and relatively inexpensive manufacture of pincer-like tools for different applications utilizing interchangeable standard parts stamped-out of steel material, especially high-grade steel. It permits the installation of normal clamps equipped with so-called "Oetiker" ears with much higher forces. The forces can be accurately controlled by the installation of auxiliary devices such as a torquing key. The same pincer-like members can also be connected to pneumatic actuating devices to provide the requisite high, accurately controlled pressure for the jaws. Similar standard stamped-out parts can also be used to assemble a pincer-like tool to install an earless clamp. Notwithstanding simplicity of such pincer-like tool, the parts thereof are completely satisfactorily guided in their purely pivotal movement. Moreover, an incorrect application of the pincer-like tool to a so-called "Oetiker" ear is made impossible by the particular construction in accordance with the present invention utilizing cheek-like guide members defining therebetween a channel.

While I have shown and described several embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A pincer-like tool for tightening clamps, comprising two pincer-like members pivotally connected with each other, two actuating handle members, each pincer-like member including engaging surface means near one end thereof for engagement with a corresponding surface of the clamp and a connecting portion near the other end thereof for connection with a respective actuating handle member so that movement of the handle members and therewith of the connecting portions toward each other will cause movement of the engaging surface means toward each other for purposes of tightening the clamp, and the pincer-like members being assembled from standard stamped-out steel parts which include nose-like end portions forming the engaging surface means, each pincer-like member being composed of at least three standard stamped-out parts fastened together in the axial direction of the pivotal connection, one of said parts being a main standard part having a head section provided with a nose-like end portion adjoined by a center section provided with means enabling the pivotal connection, which in turn is adjoined by a shank-like connecting portion for connection with a respective handle member, the pincer-like tool being for tightening a clamp having a plastically deformable ear, each pincer-like member including two main standard parts and two spacer standard parts of approximately triangular configuration which conforms at least to a substantial degree to the external lines of the head section of the main standard part including its nose-like end portion so that the engaging surface means for each pincer-like member is formed by at least four nose-like end portions, one pincer-like member being assembled of a main standard part followed by two spacer standard parts which are followed again by another main standard part, while the other pincer-like member is assembled of a spacer standard part, followed by two main standard parts which are followed again by a spacer standard part, one guide means provided at one side only of each pincer-like member, the two guide means being provided on opposite sides of the pincer-like members and extending beyond the respective nose-like end portion of the corresponding pincer-like member so that the ear can be plastically deformed only if the pincer-like tool is correctly applied.

2. A pincer-like tool according to claim 1, wherein each guide means is also formed of a standard stamped-out steel part.

3. A pincer-like tool according to claim 2, wherein the standard parts are so stamped-out that at least their exposed corners other than the nose-like end portions are rounded-off.

4. A tool according to claim 3, wherein the means enabling the pivotal connection include two holes so as to permit the assembly of two different pincer-like tools with the use of similar standard stamped-out parts, and wherein the hole nearer the nose-like end portion is used for assembling the pincer-like tool operable to tighten the ear of a clamp.

5. A pincer-like tool for tightening clamps, comprising two pincer-like members pivotally connected with each other, two actuating handle members, each pincer-like member including engaging surface means near one end thereof for engagement with a corresponding surface of the clamp and a connecting portion near the other end thereof for connection with a respective actuating handle member so that movement of the handle members and therewith of the connecting portions toward each other will cause movement of the engaging surface means toward each other for purposes of tightening the clamp, and the pincer-like members being assembled from standard stamped-out steel parts which include nose-like end portions forming the engaging surface means, and one guide means provided at one side only of each pincer-like member, the two guide means being provided on opposite sides of the pincer-like members and extending beyond the respective nose-like end portion of the corresponding pincer-like member so that the ear can be plastically deformed only if the pincer-like tool is correctly applied.

6. A pincer-like tool according to claim 5, wherein each guide means is also formed of a standard stamped-out part.

7. A pincer-like tool for tightening clamps with plastically deformable ears, comprising two pincer-like members pivotally connected with each other and terminating in two actuating handle portions, each pincer-like member including engaging surface means near the one end thereof for engagement with a corresponding surface of the clamp so that movement of the handle portions toward each other will cause movement of the engaging surface means toward each other for purposes of tightening the clamp, and guide means provided at one side only of each pincer-like member, the two guide means being provided on opposite sides of the pincer-like members and extending beyond the respective nose-like end portion of the corresponding pincer-like member so that the ear can be plastically deformed only if the pincer-like tool is correctly applied.

8. A pincer-like tool made with standard stamped-out steel parts for tightening clamps provided with tightening means, comprising two pincer-like members, means in said pincer-like members for pivotally connecting the same with each other, two actuating handle members, each pincer-like member including engaging surface means near one end thereof for engagement with a corresponding surface of the clamp and a connecting portion near the other end thereof for connection with a respective actuating handle member with the pivotal connecting means located intermediate the engaging surface means and the connecting portion of a respective pincer-like member so that movement of the handle members and therewith of the connecting portions toward each other will cause movement of the engaging surface means toward each other for purposes of tightening the clamp, and the pincer-like members being assembled from such standard stamped-out steel parts including nose-like end portions forming the engaging surface means which are assemblable to permit use of the pincer-like members made of such standard parts in realizing tools for tightening clamps with ears as well as earless clamps, and guide means for the pincer-like members to assure proper engagement of the latter during tightening of the clamp.

9. A pincer-like tool according to claim 8, wherein the tightening means is in the form of a plastically deformable ear, and wherein the guide means are provided, one each, on opposite sides of the pincer-like members in such a manner that the ear can be plastically deformed only if the pincer-like tool is correctly applied.

10. A pincer-like tool for tightening earless clamps provided with tool-engaging means in the form of pressed-out embossments according to claim 8, wherein the guide means is formed by the channel-like opening formed by two modified main standard parts on each side of a standard spacer part forming one pincer-like member with the other pincer-like member being a main standard part.

11. A pincer-like tool made with standard stamped-out steel parts for tightening earless clamps provided with tool-engaging embossment means, comprising two pincer-like members, means in said pincer-like members for pivotally connecting the same with each other, two actuating handle members, each pincer-like member including engaging surface means near one end thereof for engagement with a corresponding surface of the clamp and a connecting portion near the other end thereof for connection with a respective actuating handle member with the pivotal connecting means located intermediate the engaging surface means and the connecting portion of a respective pincer-like member so that movement of the handle members and therewith of the connecting portions toward each other will cause movement of the engaging surface means toward each other for purposes of tightening the clamp, and the pincer-like members being assembled from such standard stamped-out steel parts including nose-like end portions forming the engaging surface means which are assemblable to permit use of the pincer-like members made of such standard parts in realizing tools for tightening clamps with ears as well as earless clamps, one pincer-like member consisting of main standard part and the other pincer-like member being assembled of a spacer standard part adjoined on each side by a modified main standard part, and the tool-engaging surface means being provided in respective nose portions of the main standard part and of the standard spacer part which are so formed as to leave a shoulder on each side of the tip of the nose portion.

12. A pincer-like tool according to claim 11, wherein said tip is of a shape substantially complementary to the configuration of the embossment means to permit the tips to engage into said embossment means with the shoulder on each side of the tip operable to abut against an end surface of a corresponding embossment means.

13. A pincer-like tool for tightening clamps made with standard stamped-out steel parts, comprising two pincer-like members, means in said pincer-like members for pivotally connecting the same with each other, two actuating handle members, each pincer-like member including engaging surface means near one end thereof for engagement with a corresponding surface of the clamp and a connecting portion near the other end thereof for connection with a respective actuating handle member with the pivotal connecting means located intermediate the engaging surface means and the connecting portion of a respective pincer-like member so that movement of the handle members and therewith of the connecting portions toward each other will cause movement of the engaging surface means toward each other for purposes of tightening the clamp, and the pincer-like members being assembled from such standard stamped-out steel parts including nose-like end portions forming the engaging surface means which are assemblable to permit use of the pincer-ike members made of such standard parts in realizing tools for tightening clamps with ears as well as earless clamps, and at least one of said standard parts being provided with means to enable installation of a torquing wrench.

14. A pincer-like tool for tightening clamps made with standard stamped-out steel parts, comprising two pincer-like members, means in said pincer-like members for pivotally connecting the same with each other, two actuating handle members, each pincer-like member including engaging surface means near one end thereof for engagement with a corresponding surface of the clamp and a connecting portion near the other end thereof for connection with a respective actuating handle member with the pivotal connecting means located intermediate the engaging surface means and the connecting portion of a respective pincer-like member so that movement of the handle members and therewith of the connecting portions toward each other will cause movement of the engaging surface means toward each other for purposes of tightening the clamp, and the pincer-like members being assembled from such standard stamped-out steel parts including nose-like end portions forming the engaging surface means which are assemblable to permit use of the pincer-like members made of such standard parts in realizing tools for tightening clamps with ears as well as earless clamps, and some of said standard parts being provided with means to adjust the leverage ratio between the forces applied to the handle members and the forces exerted by the engaging surface means as a function of the forces applied to the handle members.

15. A pincer-like tool made with standard stamped-out steel parts for tightening an earless clamp provided with outwardly projecting tool-engaging embossments open in the circumferential direction of the clamp, comprising two pincer-like members, means in said pincer-like members for pivotally connecting the same with each other, two actuating handle members, each pincer-like member including engaging surface means near one end thereof for engagement with a corresponding surface of the clamp and a connecting portion near the other end thereof for connection with a respective actuating handle member with the pivotal connecting means located intermediate the engaging surface means and the connecting portion of a respective pincer-like member so that movement of the handle members and therewith of the connecting portions toward each other will cause movement of the engaging surface means toward each other for purposes of tightening the clamp, and the pincer-like members being assembled from such standard stamped-out steel parts including nose-like end portions forming the engaging surface means which are assemblable to permit use of the pincer-like members made of such standard parts in realizing tools for tightening clamps with ears as well as earless clamps, and stop means to prevent closure of the tool beyond a certain point to protect the nose-like end portions forming the engaging surface means against damage due to excessive closing of the jaws.

* * * * *